US008061686B2

(12) United States Patent
Lycette

(10) Patent No.: US 8,061,686 B2
(45) Date of Patent: Nov. 22, 2011

(54) PINCH VALVE

(75) Inventor: Mark Lycette, Berkley, MI (US)

(73) Assignee: Uniter Solar Ovonic LLC, Auburn Hills, MI (US)

( * ) Notice: Subject to any disclaimer, the term of this patent is extended or adjusted under 35 U.S.C. 154(b) by 483 days.

(21) Appl. No.: 12/417,967

(22) Filed: Apr. 3, 2009

(65) Prior Publication Data

US 2010/0252604 A1 Oct. 7, 2010

(51) Int. Cl.
*F16K 31/122* (2006.01)

(52) U.S. Cl. ..... 251/187; 251/176; 251/204; 118/718

(58) Field of Classification Search ..... 251/158, 251/176, 187, 204; 118/718; 204/298.25
See application file for complete search history.

(56) References Cited

U.S. PATENT DOCUMENTS 4,423,701 A 1/1984 Nath et al.
4,492,181 A 1/1985 Ovshinsky et al.
4,664,951 A 5/1987 Doehler
5,157,851 A 10/1992 Younan
5,824,566 A 10/1998 Sano et al.
5,951,835 A * 9/1999 Namiki et al. ..... 204/298.24
6,338,872 B1 1/2002 Yoshino et al.
6,379,994 B1 4/2002 Sano et al.
6,390,449 B1 * 5/2002 Ishigaki et al. ..... 251/193
7,100,892 B2 * 9/2006 Iwabuchi ..... 251/187
7,134,642 B2 * 11/2006 Seitz ..... 251/193
7,445,019 B2 * 11/2008 Brenes et al. ..... 137/315.29
2004/0040506 A1 3/2004 Ovshinsky et al.
2006/0278163 A1 12/2006 Ovshinsky et al.

OTHER PUBLICATIONS

"Efficiency and Throughput Advances in Continuous Roll-to-Roll a-Si Alloy of PV Manufacturing Technology" Phase II Annual Subcontract Technical Report, Jun. 1999-Aug. 2000; National Renewable Energy Laboratory, NREL/SR-520-29288, Dec. 2000.

* cited by examiner

*Primary Examiner* — John Fox
(74) *Attorney, Agent, or Firm* — Gifford, Krass, Sprinkle, Anderson & Citkowski, P.C.

(57) ABSTRACT

A pinch valve includes a valve body having a slot which is configured to allow a web of substrate material to pass therethrough. The valve body has a sealing surface which includes a first curved portion with a first radius of curvature. A dynamic seal element is configured to engage the valve body and includes a second curved portion having a second radius of curvature which is larger than the first radius of curvature. An actuator is operable to selectively bias the dynamic seal element into and out of engagement with the valve body so that when it is biased into engagement with the valve body the web of substrate material is engaged between the sealing surfaces of the dynamic seal element and the valve body. Also disclosed is a processing system which includes the pinch valve.

17 Claims, 8 Drawing Sheets

PINCH VALVE

FIELD OF THE INVENTION

This invention relates generally to valve structures used to isolate a region in a processing system. More specifically, the invention relates to a pinch valve which is operable to engage a web of substrate material in a vacuum deposition system and establish a high quality vacuum seal thereagainst.

BACKGROUND OF THE INVENTION

The high volume production of large area semiconductor devices, such as photovoltaic devices, is often carried out in a continuous deposition process. In processes of this type, one or more webs of substrate material are continuously advanced from a payoff station through a series of deposition chambers wherein various layers of semiconductor material are deposited thereonto, and the substrates are then wound into rolls in a take-up chamber. The deposition process often includes high vacuum conditions. Periodically, it is necessary to halt the deposition process so as to remove the coated web or webs of substrate material from the take-up station and replace them with fresh web material in the payout station, while isolation of certain process areas is maintained. In the prior art, it is standard practice to vent the entire deposition system to atmospheric pressure when changing webs of substrate material. In most instances, deposition of the semiconductor materials takes place at elevated temperatures and it is also necessary to cool the entire apparatus to ambient temperatures prior to venting it and replacing the substrate web.

The steps of cooling, venting and subsequently pumping the system back down to low pressure conditions and reheating the deposition chambers is very time consuming. In addition, exposure to ambient atmospheric conditions can introduce moisture or other contaminants into the deposition system. Therefore, the prior art has attempted to find systems which would allow for replacement of substrate webs without requiring venting of the deposition chambers of the apparatus. Toward that end, the prior art has implemented pinch valve systems in which the substrate payout station and take-up station are provided with a valving assembly which closes against a portion of a halted substrate web retained therein. In this manner, the deposition chambers of the apparatus may be maintained under vacuum conditions with a portion of the length of the substrate therein. A new web of substrate material is joined to the halted substrate web by welding it or otherwise affixing it to a portion of the substrate web projecting from apparatus of the system. Following pump down of the substrate station, the pinch valve is opened and the deposition process resumed. Pinch valves used in a system of this type must be capable of maintaining a very good seal at a pressure differential of 1 atmosphere. Also, given the fact that mechanical tolerances and spatial clearances within continuous process deposition apparatus of this type are generally quite small and very precise, any such pinch valve must not significantly deform the substrate material so as to minimize jamming, misalignment or other undesirable effects when the apparatus is restarted.

The prior art has recognized the need for pinch valves of the type described and has implemented a number of embodiments. For example, U.S. Pat. No. 5,157,851 discloses a pinch valve comprised of two movable members which engage a base. U.S. Pat. No. 6,338,872 discloses a pinch valve in which a blade-like gate member pushes a substrate against a resilient, planar, support surface. A similar pinch valve incorporating a rubber plate is described in general terms in U.S. Pat. No. 5,824,566.

As will be explained in detail hereinbelow, the present invention provides a pinch valve which is simple in construction, reliable, and which is capable of engaging a substrate so as to provide a very high isolation seal without significantly deforming or damaging the substrate. These and other advantages of the invention will be apparent from the drawings, discussion and description which follow.

SUMMARY OF THE INVENTION

The present invention is directed to a pinch valve which includes a valve body having a slot defined therein. The slot is configured to allow a web of substrate material to pass through the pinch valve. The valve body has a sealing surface which includes a first curved portion having a first radius of curvature. The pinch valve includes a dynamic seal element having a sealing surface which includes a second curved portion having a second radius of curvature which is larger than the first radius of curvature. The pinch valve further includes an actuator for selectively biasing the dynamic seal element into and out of engagement with the valve body so that when the dynamic seal element is biased into engagement with the valve body the web of substrate material is engaged between the sealing surfaces of the dynamic seal element and the valve body.

In particular embodiments of the invention, at least one of the valve body and the dynamic seal element has a resilient sealing member disposed upon at least a portion of its respective sealing surface. The resilient sealing member may be comprised of a silicone polymer, and in particular instances both the valve body and the dynamic seal element include a resilient sealing member disposed thereupon. In particular instances, the sealing surface of the valve body includes at least one planar segment extending from its first curved portion. In further instances, the sealing surface of the dynamic seal element includes at least one planar segment extending from its second curved portion. In some embodiments, the dynamic seal element includes a resilient sealing member having two different thicknesses.

The actuator, in some instances, may include an eccentric cam which operates to move a push rod which push rod biases the dynamic seal element into and out of engagement with the valve body. The biasing force exerted by the actuator may be in the range of 40-80 psi. In specific embodiments, the pinch valve is characterized in that at a pressure differential of 1 atmosphere maintained thereacross. In another instance, the pinch valve manifests a leak rate which is in the range of $5\times10^{-5}$ to $5\times10^{-9}$ torr liter/minute. In certain instances, the leak rate is no more than $5\times10^{-7}$ torr liter/minute.

Also disclosed is a system for depositing a semiconductor material onto a web of substrate material in a continuous roll-to-roll process, which system includes at least one of the pinch valves. In specific embodiments, the deposition system is a multiple web system for simultaneously depositing a material onto a plurality of webs moving therethrough. Specifically disclosed is a multi-web pinch valve which may be used in such deposition or other processing systems.

DETAILED DESCRIPTION OF THE INVENTION

The present invention will be described with reference to pinch valves incorporated into systems for continuously depositing semiconductor material onto a moving web of substrate material. However, it is to be understood that the principles of the present invention may be extended to variously configured pinch valves used in other applications where it is desirable to isolate/maintain an area of a processing system using the pinch valve during a stop cycle or while another operation is performed at another portion of the processing system. For example, it may be desirable to maintain a condition (e.g. temperature, pressure, composition, etc.) within an area adjoining the pinch valve. In one application, it may be desirable to maintain the adjoining area free from atmosphere elements or contaminate. In another application, it may be desirable to contain a composition within a chamber and not release portions thereof outside the chamber, for example, not releasing a hazardous gas from within the chamber of the processing system. Further and as previously discussed herein, isolating and maintaining a desirable condition of a processing area without damage to the substrate, for example during a stop cycle of the processing system, can save time and resources otherwise applied to return the isolated area back to the desirable condition to resume operation of the processing system.

Figure 1:
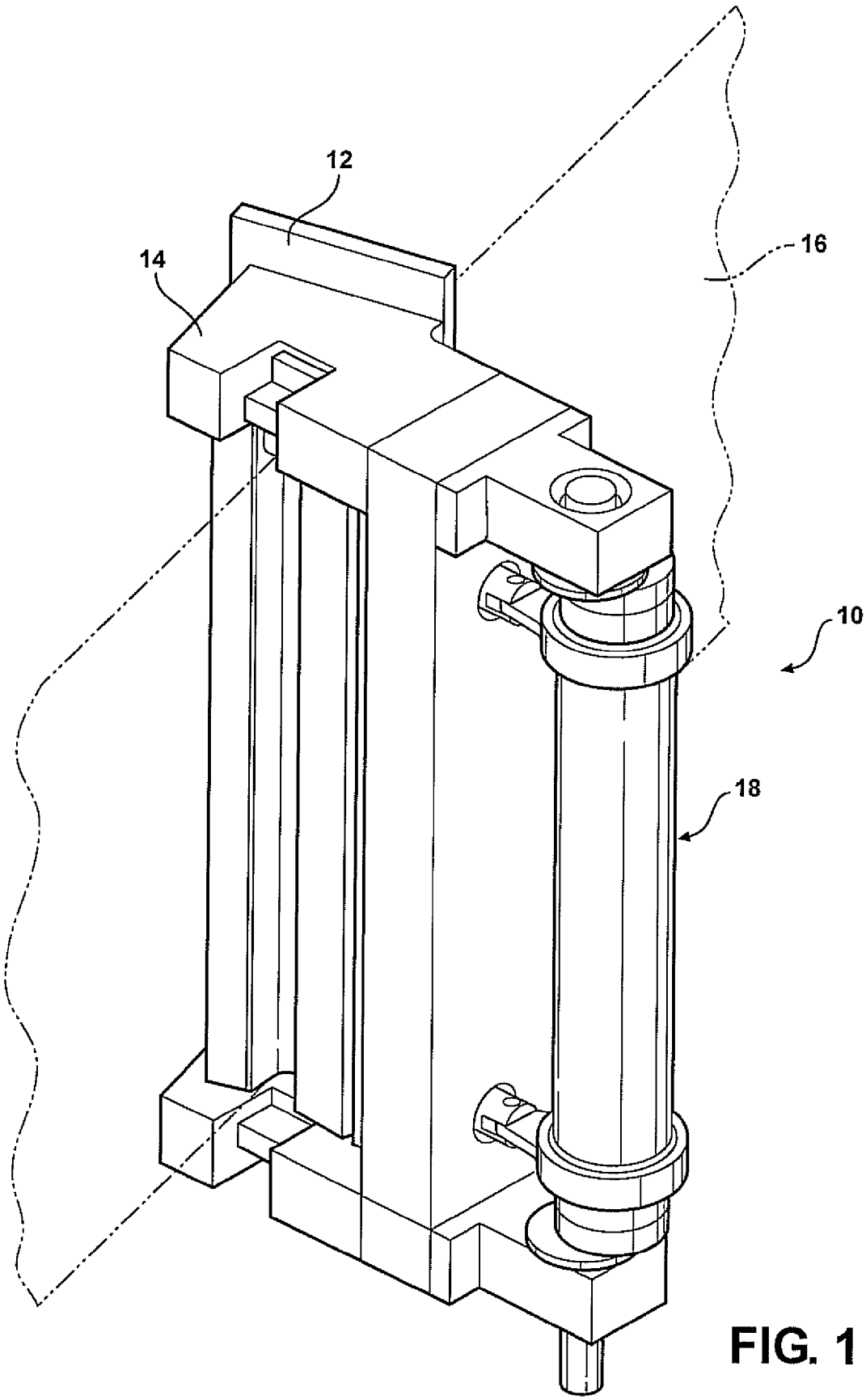
FIG. 1 is a perspective view of a pinch valve in accord with the present invention showing a web of substrate material passing therethrough in phantom outline.

Referring now to FIG. 1, there is shown a perspective view of a pinch valve 10 in accord with the present invention. This pinch valve 10 may be incorporated into a deposition system of the type previously described, and in that regard, it includes a mounting flange 12 which can allow it to be secured to, for example, structure of a vacuum chamber. The pinch valve 10 includes a valve body 14 having a slot defined therein so as to allow a web of substrate material 16 (shown in phantom outline in FIG. 1) to pass therethrough when the valve is in its open position. The pinch valve 10 includes an actuator 18 which, as will be described hereinbelow, operates to open and close the valve assembly. The pinch valve can be fabricated from materials that withstand loads applied thereto and that do not degrade processes of the system that incorporates the valve assembly. For example, it would not be desirable to have a material of the pinch valve that releases gases, contaminate or otherwise degrade the integrity of the processing system. In certain embodiments, materials of the pinch valve include aluminum, mild or high-strength steel, stainless steel, high strength plastic, an elastomer, and combinations thereof. In the present embodiment and unless otherwise noted herein, many of the components of the pinch valve are made from aluminum and high-strength steel.

Figure 2:
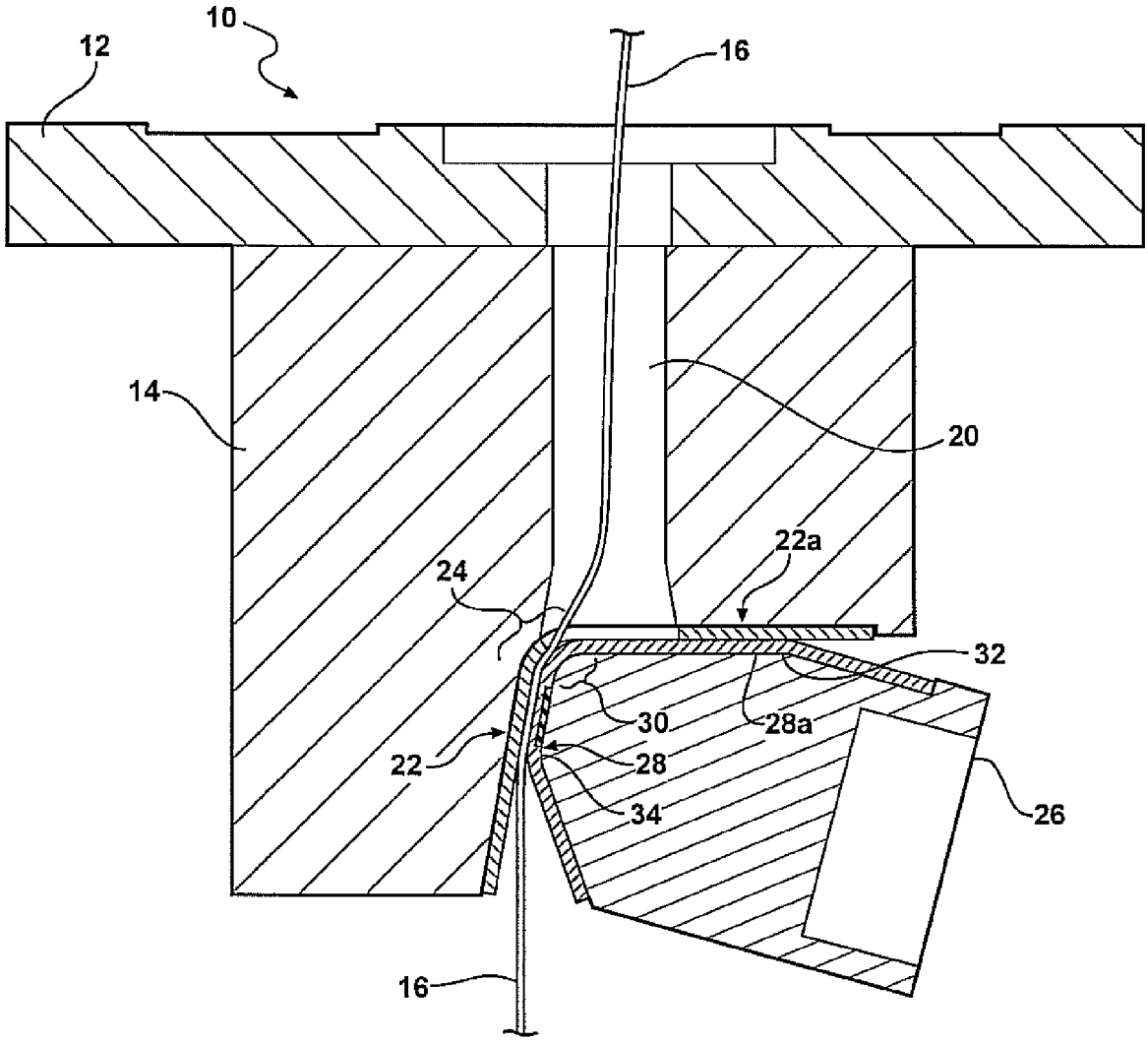
FIG. 2 is a cross-sectional view of the pinch valve of FIG. 1.

Referring now to FIG. 2, there is shown an end view of a portion of the pinch valve 10 of FIG. 1. Depicted in FIG. 2 is the mounting flange 12 having a particular configuration to suit the type of apparatus upon which the valve is mounted. The valve 10 of FIG. 2 includes a valve body 14. The valve body 14 includes a slot 20 defined therethrough configured to allow the web of substrate material 16 to pass through the valve body. The valve body 14 has a sealing surface 22 defined thereon, and as illustrated, the sealing surface includes a curved portion 24, and as shown, two relatively planar segments project from the curved portion 24; these planar segments further enhance the quality of the vacuum seal established by the assembly. For example, the planar segments can be configured to provide an attachment surface area (here for adhesion) for additional sealing elements and/or for providing sealing surface engagement during operation of the pinch valve.

Further shown in FIG. 2 is a dynamic seal element 26 which operates in cooperation with the valve body 14 to seal about the substrate web. An approximate, non-limiting deflected shape of the substrate web 16 is shown when the web is engaged between the dynamic seal element and the valve body. The dynamic seal element 26 includes a sealing surface 28 which also has a curved portion 30. When the dynamic seal element is actuated to a closed position, to engage the web against the valve body, a portion of the web is sealed between sealing surface 22 of the valve body and sealing surface 28 of the dynamic seal element.

As shown, the sealing surface 28 of the dynamic seal element also includes planar portions which project from the curved portion and these portions cooperate with the corresponding planar positions on the valve body 14. It is also to be noted that the dynamic seal element 26 includes two curved segments 32 and 34 which are optional; however, from which an additional planar portion depends away from each of the curved segments to provide for some mechanical clearance between the dynamic seal element 26 and the valve body 14. The additional planar portions provide more attachment surface area (here, improved adhesion) for a sealing element, such as a gasket, to be secured to the sealing surface 28 of the dynamic seal element 26 so the gasket material is less likely to become detached from the seal surface at the area of engagement between the dynamic seal element and the valve body. In other implementations of the invention, other modifications may be made as apparent to those of skill in the art.

Figure 3:
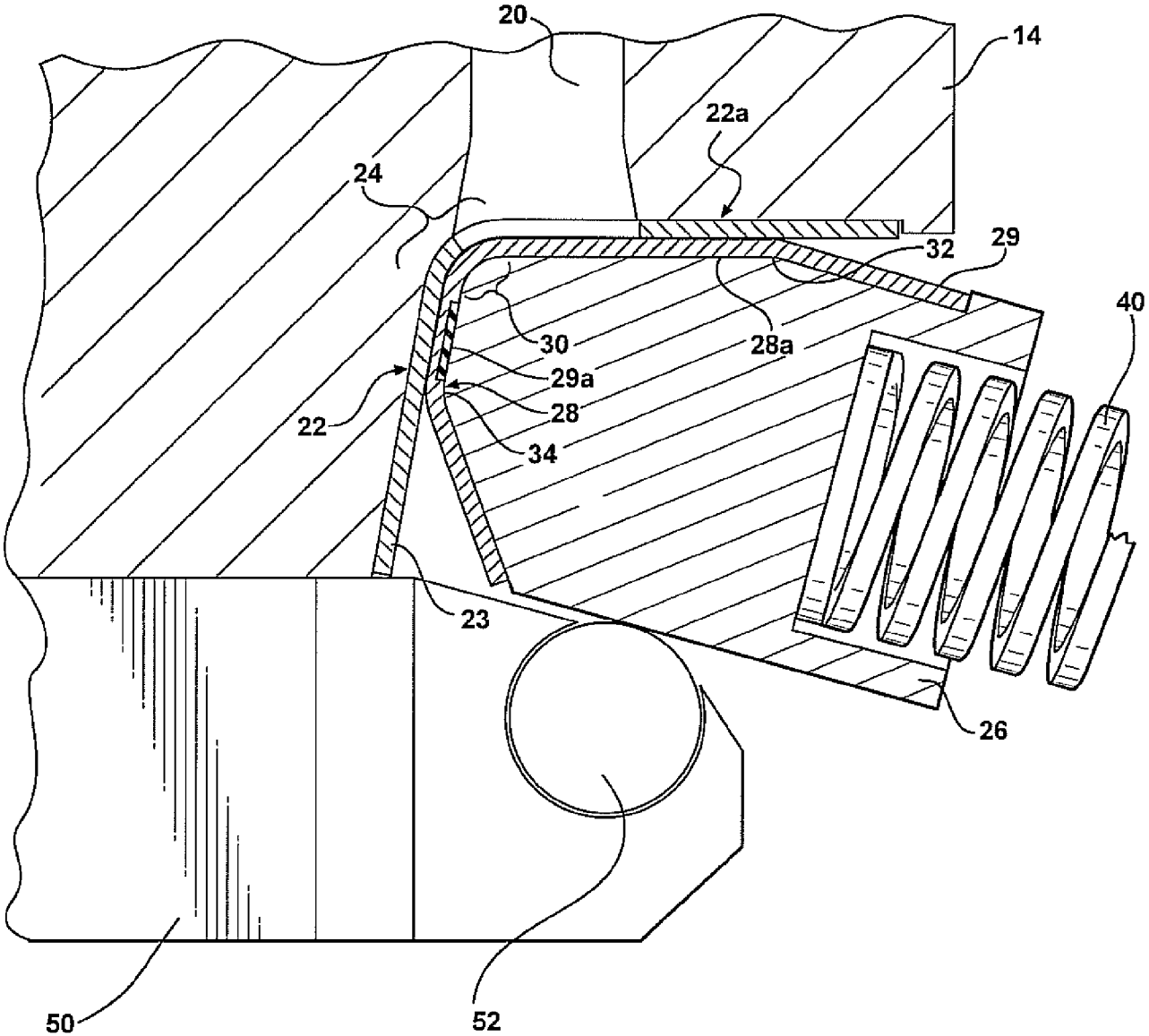
FIG. 3 is an enlarged view of a portion of the drawing of FIG. 2, including a cam assembly and better illustrating the elastomeric sealing members.

Referring now to FIG. 3, there is shown an enlarged view of a portion of the drawing of FIG. 2 better showing the interaction of the valve body 14 and dynamic seal element 26. As shown in FIG. 3, the sealing surface 22 of the valve body 14 has a sealing, resilient member 23 disposed thereupon. In this embodiment, the resilient member 23 is fabricated from a silicone rubber and has a thickness of 0.6 inches. One type of silicone rubber having utility in this application has a durometer (shore) rating of 30-70, and in particular a rating of 40. In this embodiment, the material can tolerate temperatures up to 500° C. Other natural and synthetic elastomers will be apparent to those of skill in the art.

The sealing surface 28 of the dynamic seal element 26 also includes a resilient member 29 disposed thereupon. In this embodiment, this resilient member 29 is also a body of silicone rubber, which may be of the type described above, having a thickness of 0.6 inches. As will be further noted, a portion of the sealing surface 28 of the dynamic seal element 26 includes a shim member **29*a* thereupon. This shim member 29*a* is also resilient and may comprise a 0.3 inch thick portion of the aforedescribed silicone rubber. The inclusion of the shim has been found to further enhance the degree of vacuum seal achieved by this valve. As noted above, other natural and synthetic elastomers may be used for the resilient member 29. In an alternative embodiment, the shim can be an integral portion of a composite resilient member. The shim member 29***a* is disposed so as to be in that portion of the sealing surface 28 of the dynamic seal element 26 which will contact a predetermined area of the substrate web disposed in the pinch valve at engagement. The presence of the shims changes the effective thickness and/or resiliency of those portions of the sealing surface 28 with which it is associated so as to provide for sealing conditions which will vary across the width of a web associated therewith. For example, the shim can be configured and the dynamic seal element actuated to provide a greater sealing pressure against a surface of the web near and/or at an edge of the web, compared to a sealing pressure against other portions of the substrate web across its width. It is to be understood that the pinch valve can have a plurality of shims and shim configurations to provide a variety of pressures for sealing and isolation about the substrate web. As will be discussed hereinbelow, the pinch valve can be further configured to have multiple degrees of compliance for controlling one or more sealing areas about the substrate web within the pinch valve.

As previously mentioned, the sealing surface 22 of the valve body 14 includes planar portions projecting from the curved portion 24. As is specifically illustrated in FIG. 3, one of these planar portions is shown at reference numeral 22*a*. Likewise, the sealing surface 28 of the dynamic seal element 26 has corresponding planar portions projecting from its curved section 30. One such planar portion is shown at reference numeral 28*a*. As mentioned above, these planar portions serve to enhance the quality of the vacuum seal, particularly in the region of the slot 20. As will further be seen from FIG. 3, the sealing surface 28 of the dynamic seal element includes two curved segments 32 and 34 which bend the contact surface of the dynamic seal element away from the contact surface of the valve body. These two curved segments provide clearance between the elastomeric sealing materials of the two elements at non-engaged surfaces. The planar portions extending from the curved segments provide additional adhesion area between the resilient member 29 and the dynamic seal element to minimize the possibility of the resilient member separating from the dynamic seal element.

As will further be seen in FIG. 3, the dynamic seal element 26 has a resilient compliance element, in this instance spring 40, associated therewith. This spring is configured to provide for some cushioning and compliance in the motion of the dynamic seal element as it is biased into engagement with the valve body. This allows for the formation of a tighter seal against the substrate web without causing damage to the substrate web engaged therewith. Other resilient elements may be substituted for the spring, and these can include elastomeric bodies, hydraulic or pneumatic cylinders, magnetic devices, and the like. The sealing action between the dynamic seal element and the valve body can also be configured to include multiple degrees of compliance to seal against portions of the substrate web and at an area local to the sealed web, thereby the pinch valve provides an enhanced sealing or isolation function. For example, shown in FIG. 3 is a cam assembly 50 which is affixed to and supported by the valve body 14. The cam assembly includes a cam member, which in this instance is an eccentric roller 52 which is disposed so as to engage a surface of the dynamic seal element 26 as it is biased toward an engagement position with the valve body 14. In this embodiment as the dynamic seal element is actuated into engagement with the valve body, the cam 52 acts to urge the dynamic seal element 26 into strong and smooth contact toward at least surfaces 22 and 22*a* of the valve body in the region of the slot 20. Inclusion of the cam assembly is optional, but it has been found to enhance the integrity of the vacuum seal in the region of the slot. Other configurations of cam assembly will be readily apparent to those of skill in the art.

It is a significant feature of the pinch valve of the present invention that it can be closed onto a web of substrate material without causing any major damage to the web, such as a wrinkle, burr, indentation, crease, crack, etc. In that regard, the geometry of the sealing surfaces of the valve body and dynamic seal element are selected so as to avoid imposing excessive forces on the web. In the embodiment shown in FIG. 3, the pinch valve is configured/positioned and in particular the sealing surface 22 of the valve 14 and the corresponding sealing surface 28 of the dynamic seal element 26 are inclined relative to the substrate web orientation before it enters the slot. As specifically shown in FIG. 3, sealing surfaces 22, 28 are inclined by an angle of approximately 10 degrees. In pinch valves of other configuration, these angles may be greater or smaller; but, in many instances, the angle will be no more than 30 degrees.

Figure 4:
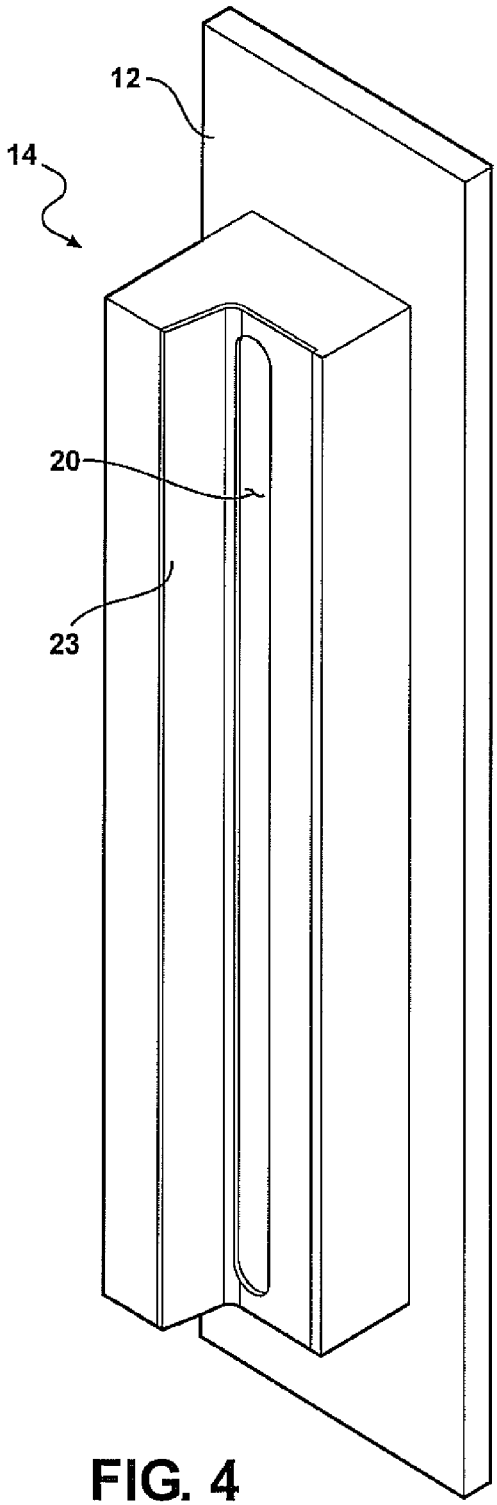
FIG. 4 is a perspective view of the valve body of FIG. 1.
Figure 5:
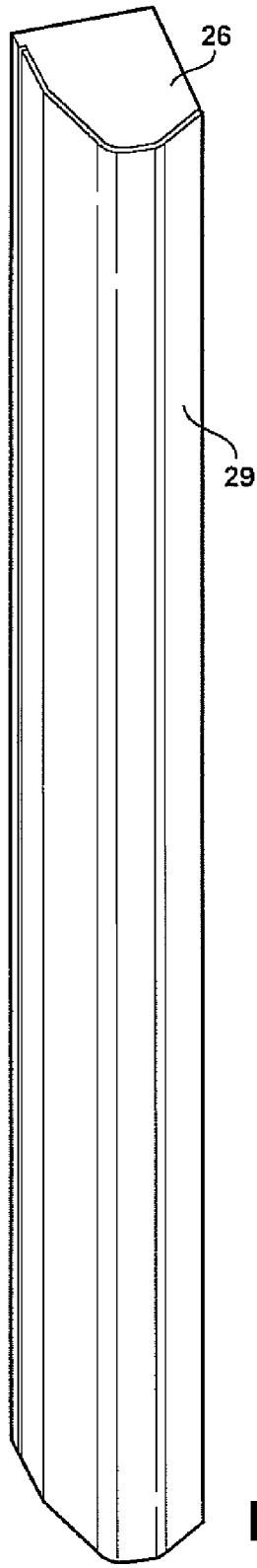
FIG. 5 is a perspective view of the dynamic seal element of the FIG. 1 embodiment.

Referring now to FIG. 4, there is shown a perspective view of the valve body 14. Visible in FIG. 4 is the flange 12, the slot 20, and the resilient member 23. As will be seen, the resilient member 23 covers a substantial portion of the sealing surface of the valve body. Referring now to FIG. 5, there is shown a perspective view of the dynamic seal element 26 showing the resilient member 29 which is disposed thereupon.

Figure 6:
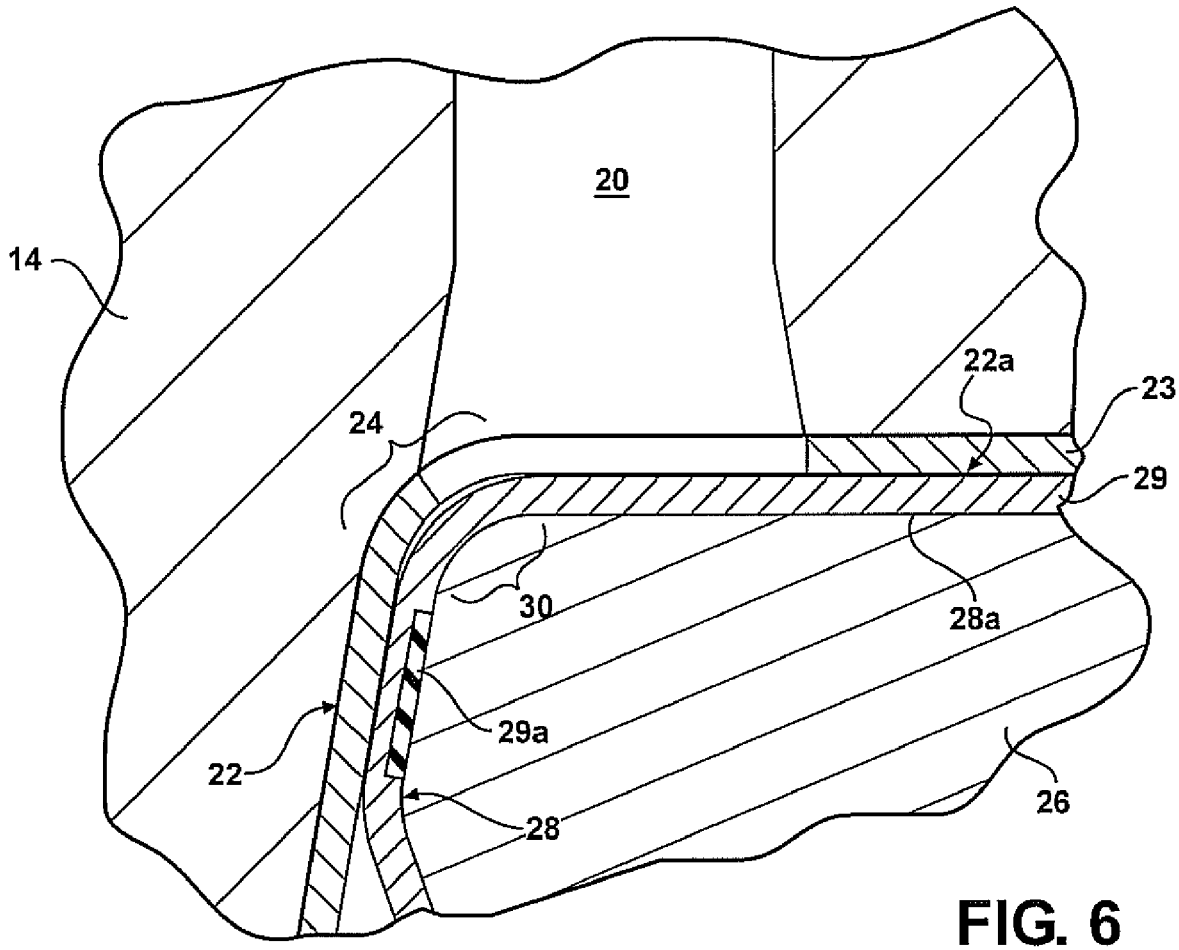
FIG. 6 is a further enlarged view of a portion of FIG. 2 specifically showing the manner in which the dynamic seal element engages the valve body.

Referring now to FIG. 6, there is shown an enlarged view of a portion of FIG. 3 better showing the contact between the valve body 14 and dynamic seal element 26. FIG. 6 shows the sealing surface 22 of the valve body 14, it's associated elastomeric resilient member 23, and indicates the curved portion 24 of sealing surface 22. Likewise, the figure shows the sealing surface 28 of the dynamic seal element 26 and further illustrates resilient member 29 and shim member 29*a*. Also shown therein is the curved portion 30. In the present embodiment, the sealing surface 28 of the dynamic seal element 26 is configured so that the curved portion 30 has a radius of curvature which is greater than the corresponding curved portion 24 of the sealing surface 22 of the valve body 14. It has been found that by so configuring the respective curved portions, the quality of the vacuum seal in the region where the substrate material passes into the slot 20 is enhanced, thus improving the performance of the pinch valve without damaging the substrate web at that location. In an alternative embodiment, a shim could be incorporated into the resilient member 23 at/near the location of the shim 29*a* for enhancing the sealing function.

Figure 7:
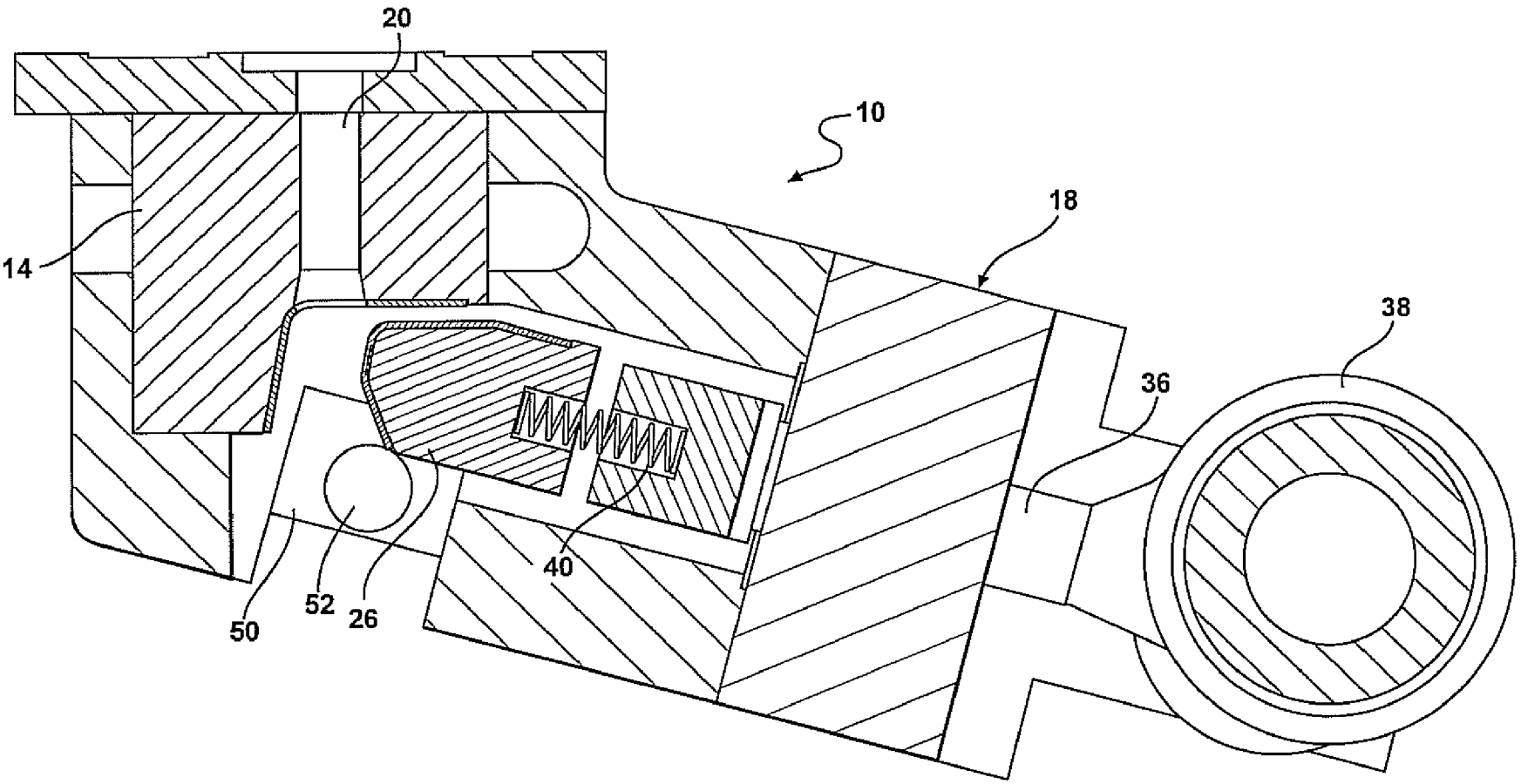
FIG. 7 is a cross-sectional view of the pinch valve of FIG. 1 specifically illustrating the actuator.

In the operation of the pinch valve 10, the dynamic seal element 26 is biased into and out of engagement with the valve body 14, and in this specific embodiment, such biasing is accomplished by an actuator. Referring now to FIG. 7 there is shown a cross-sectional view of the pinch valve 10 of the foregoing figures as disposed in its open, non-engaged condition, and in this regard, the dynamic seal element 26 is retracted away from contact with the valve body 14.

The FIG. 7 drawing further shows an actuator 18 which operates to move the dynamic seal element 26 so as to open and close the pinch valve. The actuator 18 includes, in this particular embodiment, an eccentric drive tube 38 which is rotatable by a rotary drive (not shown). The eccentric drive tube, when rotated, moves a push rod 36 along a path of travel and this push rod 36 engages the dynamic seal element 26, between the open and closed positions, with the valve body 15. When the valve is closed, the dynamic seal element 26 is urged against the substrate material 16 in a manner to urge the substrate against the sealing surface of the valve body 14. In other embodiments, the actuator may comprise a solenoid, a hydraulic cylinder, a pneumatic cylinder, a motor/screw drive, or other mechanical and electromechemical linkages. In some instances, it will be advantageous to include a cushioning element such as a spring 40 or other resilient member in the actuator linkage so as to provide a "shock absorber" function, another degree of compliance, to further enhance sealing/isolation and minimize damage to the substrate web.

It has been found that the pinch valve described in the foregoing provides a very high degree of isolation of a region for a deposition apparatus. In a typical application, the pinch valve provides desirable sealing pressures against portions of the substrate web, for instance in the ranges of 20-120 psi, 40-80 psi, and in specific instances at approximately 60 psi. In an experimental series, valve assemblies configured in accord with the foregoing were closed against a substrate web of 5 mil thick stainless steel and when subjected to a pressure differential of 1 atmosphere were found to have a leak rate in the range of $5\times10^{-5}$ to $5\times10^{-9}$ torr liter/minute, and in particular instances a leak rate of no more than $5\times10^{-7}$ torr liter/minute.

The pinch valve of the present invention may be configured in a variety of embodiments and incorporated into various deposition systems for the deposition of materials over a web of substrate material. In particular instances an embodiment of the pinch valve may be advantageously employed in multi-web systems of the type wherein a plurality of substrate webs are simultaneously advanced through one or more coating stations and thence to a take-up chamber. Some such systems are shown in U.S. Pat. No. 4,423,701 and U.S. Patent Application Publication 2004/0040506. The disclosures of both of these documents are incorporated herein by reference.

In a multiple web deposition system, each web may have a discrete pinch valve disposed between a payout chamber and a deposition station and another discrete pinch valve disposed between a deposition station and a take-up chamber. Alternatively, a multiple web pinch valve may be configured and disposed so as to seal a plurality of webs therebetween. All of such pinch valves may be configured to operate in accord with the present invention.

Figure 8:
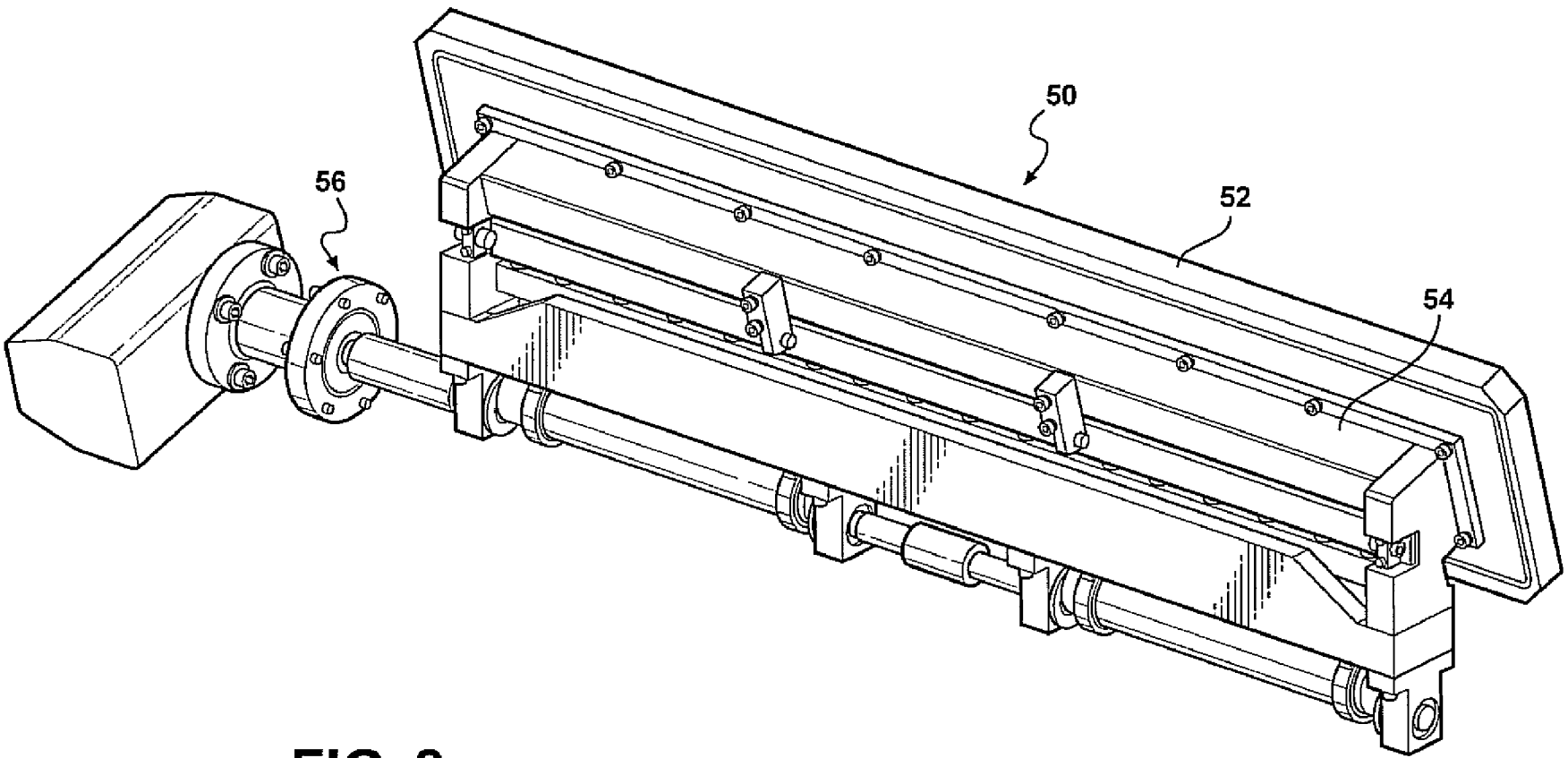
FIG. 8 is a perspective view of a web pinch valve capable of sealing against multiple webs and passing the webs therethrough.

Referring now to FIG. 8, there is shown a pinch valve 50 as structured to accommodate three separate substrate webs and to allow the webs to pass therethrough in a spaced, side by side relationship. The pinch valve 50 includes a valve body 52 and a dynamic seal element 54 configured and operable to engage the webs with the valve body. As in the previous embodiment, the dynamic seal element 54 is generally similar to the dynamic seal element previously described with regard to geometry and functionality. The dynamic seal element 54 is biased toward contact with the valve body 52 by an actuator system 56.

Figure 9:
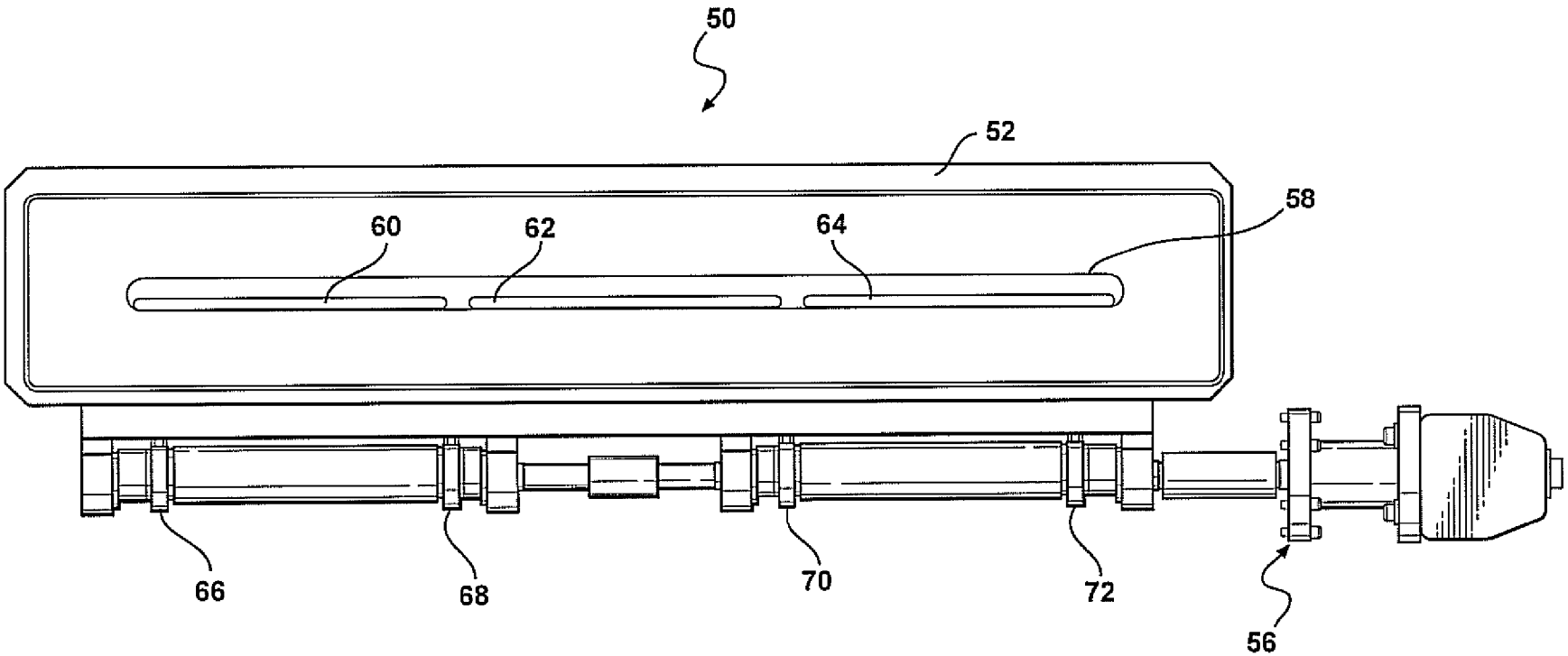
FIG. 9 is a front view of the web pinch valve of FIG. 8.

Referring now to FIG. 9, there is shown a front view of the pinch valve 50 of FIG. 8. The valve body 52 includes a slot 58 defined therein. In this instance, the valve body includes a single slot; however, other embodiments may include multiple slots. As in the previous embodiment of pinch valve 10 even though not all components are shown, a sealing surface of the valve body 52 engages with a corresponding sealing surface of the dynamic seal element 54 and includes resilient gasket materials and at least one shim as discussed hereinabove. In the FIG. 9 embodiment, the substrate webs 60, 62 and 64 are positioned in the slot 58.

Further visible in the FIG. 9 is the actuator system 56 which comprises a rotary shaft having a number of actuating mechanisms 66, 68, 70 and 72 disposed thereupon. As described with reference to the previous embodiment, the actuating mechanisms convert rotary motion to linear motion to drive the dynamic seal element 54 toward engagement with the valve body 52.

It is to be understood that yet other embodiments of multi-web pinch valve may be configured in accord with the principles of the present invention in view of the teaching presented herein.

The foregoing has described some specific embodiments of the present invention with regard to their incorporation into a system for the continuous deposition of thin film bodies of semiconductor material. It is to be understood that the present invention may be implemented in various other configurations and may be adapted for other uses. All of such modifications, variations and applications will be apparent to those of skill in the art in view of the teaching presented herein. It is to be understood that the figures of this disclosure are not drawn to scale, rather the figures are drawn to illustrate most clearly the principles of this disclosure discussed herein. The foregoing drawings, discussion and description are illustrative of specific embodiments of the invention, but are not meant to be limitations upon the practice thereof. It is the following claims, including all equivalents, which define the scope of the invention.

The invention claimed is:

1. A pinch valve comprising:

a valve body having a slot defined therein, said slot being configured to allow a substrate web to pass therethrough, said valve body having a sealing surface which includes a first curved portion having a fist radius of curvature;

a dynamic seal element having a sealing surface which includes a second curved portion having a second radius of curvature which is larger than the first radius of curvature; and an actuator for selectively biasing said dynamic seal element into and out of engagement with the valve body so that when said dynamic seal element is biased into engagement with the valve body the substrate web is engaged between the sealing surface of the valve body and the sealing surface of the dynamic seal element.

2. The pinch valve of claim 1, wherein at least one of said valve body and dynamic seal element has a resilient member disposed on at least a portion of its respective sealing surface.

3. The pinch valve of claim 2, wherein said resilient member is comprised of a silicone polymer.

4. The pinch valve of claim 3, wherein said silicone polymer has a durometer rating (shore) in the range of 30-70.

5. The pinch valve of claim 2, wherein said valve body and said dynamic seal element each include a resilient member disposed upon their respective sealing surfaces.

6. The pinch valve of claim 2, wherein said dynamic seal element includes a resilient member having two different thicknesses, so that when the sealing surfaces of the valve body and the dynamic sealing element contact the web, they establish sealing conditions which vary across the width of the web.

7. The pinch valve of claim 1, further including a cam assembly disposed so as to bias the dynamic seal element toward a surface of the valve body when the actuator biases the dynamic seal element into engagement with the valve body.

8. The pinch valve of claim 1, wherein the sealing surface of said valve body includes at least one planar segment extending from said first curved portion.

9. The pinch valve of claim 1, wherein the sealing surface of said dynamic seal element includes at least one planar segment which extends from the second curved portion.

10. The pinch valve of claim 1, wherein said actuator includes an eccentric member which operates to move a push rod so as to bias said dynamic seal element into and out of engagement with said valve body.

11. The pinch valve of claim 1, wherein said actuator is operable to bias said dynamic seal element into engagement with said valve body with a force of 40-80 psi.

12. The pinch valve of claim 1, further characterized in that at a pressure differential of 1 atmosphere the pinch valve manifests a leak rate in the range of $5\times10^{-5}$ to $5\times10^{-9}$ torr liter/minute.

13. The pinch valve of claim 1, wherein said slot in said valve body is configured so as to allow at least two substrate webs to pass therethrough in a side-by-side relationship.

14. The pinch valve of claim 13, wherein said dynamic seal element is configured and operable to contact said at least two substrate webs.

15. The pinch valve of claim 1, further comprising at least an additional degree of compliance in a manner to urge the dynamic seal element into engagement with the valve body.

16. The pinch valve of claim 15, wherein the additional degree of compliance urges the dynamic seal element toward a surface of the valve body where the dynamic seal element not urged against the substrate web.

17. The pinch valve of claim 15, wherein the valve body further comprises a resilient member, the dynamic seal element further comprises a resilient member, and at least one of the valve body and the dynamic seal element further comprise a shim member at a location of engagement between the valve body and the dynamic seal element.

* * * * *